US007249618B2

(12) United States Patent
Lacroix

(10) Patent No.: US 7,249,618 B2
(45) Date of Patent: Jul. 31, 2007

(54) DEVICE FOR FILLING A FLEXIBLE POUCH

(75) Inventor: Jean Pierre Lacroix, Annecy le Vieux (FR)

(73) Assignee: Medex SA, Annecy le Vieux (FR)

( * ) Notice: Subject to any disclaimer, the term of this patent is extended or adjusted under 35 U.S.C. 154(b) by 133 days.

(21) Appl. No.: 10/516,664

(22) PCT Filed: May 12, 2003

(86) PCT No.: PCT/FR03/01430

§ 371 (c)(1),
(2), (4) Date: May 19, 2005

(87) PCT Pub. No.: WO03/101885

PCT Pub. Date: Dec. 11, 2003

(65) Prior Publication Data

US 2005/0205158 A1 Sep. 22, 2005

(30) Foreign Application Priority Data

May 30, 2002 (FR) ..... 02 06606

(51) Int. Cl.
*B65B 1/04* (2006.01)

(52) U.S. Cl. ..... 141/313; 141/114; 141/329; 604/416

(58) Field of Classification Search ..... 141/10, 141/114, 67, 313–319, 391, 329; 604/408, 604/416; 222/400.7, 400.8
See application file for complete search history.

(56) References Cited

U.S. PATENT DOCUMENTS

| | | | | |
|---|---|---|---|---|
| 2,595,262 | A * | 5/1952 | Hood | 141/7 |
| 3,807,467 | A | 4/1974 | Tascher et al. | 141/375 |
| 5,207,638 | A * | 5/1993 | Choksi et al. | 604/6.11 |
| 5,351,859 | A * | 10/1994 | Jansen | 222/82 |
| 5,848,623 | A * | 12/1998 | Ueda | 141/64 |
| 5,887,760 | A * | 3/1999 | Johnson | 222/209 |

FOREIGN PATENT DOCUMENTS

FR 947873 7/1949

* cited by examiner

*Primary Examiner*—Steven O. Douglas
(74) *Attorney, Agent, or Firm*—Fay Sharpe LLP

(57) ABSTRACT

A device (1) fills a flexible pouch (100) with medicinal fluids. The pouch is mounted with its distal end (113) upward and attached to a filling infuser (110) which is supported in a supporting bore (121). A neck end of the supply container (200) which carries a resilient cap (202) is inserted into the bore such that the filling infuser pierces the cap. A flexible bladder (31) or a squeeze bulb (33) is connected with an air inlet (116) of the filling infuser to inject pressurized air into the supply container and accelerate the transfer of medicinal liquids from the supply container to the flexible pouch.

12 Claims, 5 Drawing Sheets

DEVICE FOR FILLING A FLEXIBLE POUCH

BACKGROUND OF THE INVENTION

The present invention concerns a filling apparatus for a flexible pouch.

The invention finds particular advantage, but not exclusive, in the field of the injection of liquids in medicine.

In medicine, the injection of liquids is currently employed notably during giving transfusions, perfusions, artificial nutrition vascularly or digestively, injections of contrast agents, etc. Of all the known techniques, the high pressure injection of liquid contained in flexible pouches constitutes one of the best in medicine for achieving satisfactory hygiene.

The principle consists of using a flexible pouch which, like its name indicates, is typically made of a pouch of flexible material containing in one part a medical liquid for injection and equipped at another part with a reusable fitting. This fitting is for connection, possibly by an intermediate tube of adequate length, to a detachable injection conduit, such as a catheter or a hypodermic needle. The flexible pouch is then placed in an enclosure containing an inert liquid capable of being put under pressure for the purpose of compressing the pouch, forcing the liquid to flow out through the injection conduit, possibly through the intermediate tube.

If the injection of liquid contained in the flexible pouch constitutes a technically satisfactory operation, the refilling of the pouch properly is a time consuming operation since it is carried out just by gravity. One uses generally a filling device constituted by simply a refilling infuser that is put in place manually removable from the end of the reusable fitting of the flexible pouch.

The refilling infuser typically includes two conduits. The first conduit connects its distal end, that is intended to be connected to other external devices, to its proximal end that is intended to be connected to the internal volume of the flexible pouch. The second conduit connects the same distal end to an air inlet leading to the exterior and typically coupled to a filter that is impermeable by liquids.

When refilling the flexible pouch, the refilling infuser is simply maintained vertically, such that its distal end is oriented toward the top such that the later can be forced through the cap of a supply container that is oriented such that it is toward the bottom. The air inlet can then play its role of permitting the entrance of air to the interior of the supply container via the second conduit and consequently the out flow of liquids out of the supply container by the first conduit. The liquid then is going to be forced to flows out through the connection to refill the flexible pouch.

This type of filling device functioning just by gravity presents many times the inconvenience of rendering the filling operation particularly long.

The technical problem to be resolved, by the object of the present invention, is to propose a filling device for a flexible pouch, intended to introduce a liquid into a flexible pouch connected to a filling infuser by pressurizing an air inlet, filling device that will permit the avoidance of the problems of the prior technique permitting an acceleration just of the out flow of liquid into the flexible pouch and hence rapid refilling.

SUMMARY OF THE INVENTION

The solution to the long-lived technical problem includes, according to the present invention, a filling device that comprises:

attaching means for the flexible pouch adapted to position the distal end of a filling infuser toward the top, supporting means for receiving a supply container containing the liquid for introduction, said attaching means being adapted to position said supply container in a position such that the liquid flows out by gravity when said receptacle is connected to a filling infuser, air compressing means, connecting means for connecting the compression means and the air inlet of the filling infuser.

Positioned this way, the supply container is typically connected to the flexible pouch by the filling infuser, in a manner that the liquid can flow out by gravity. But in addition, the air inlet that is also connected to the supply container communicates with the compression means suitably to bring air under pressure to the interior of the aforesaid receptacle. The implementation of this compression means goes consequently to increase the pressure of the air in the supply container. This positive pressure goes then to push the liquid by the only accessible out flow orifice such that it goes through the filling infuser and is guided to the flexible pouch. The fitting finds itself advantageously accelerated.

The present invention concerns also the characteristics that will come out in the course of the description that is will follow, and should be considered individually or according to all their possible combinations.

BRIEF DESCRIPTION OF THE DRAWINGS

Other characteristics and advantages of the invention will become apparent from the following description and the attached drawings which are exemplary only and not limiting.

DETAILED DESCRIPTION OF THE PREFERRED EMBODIMENTS

Figure 1:
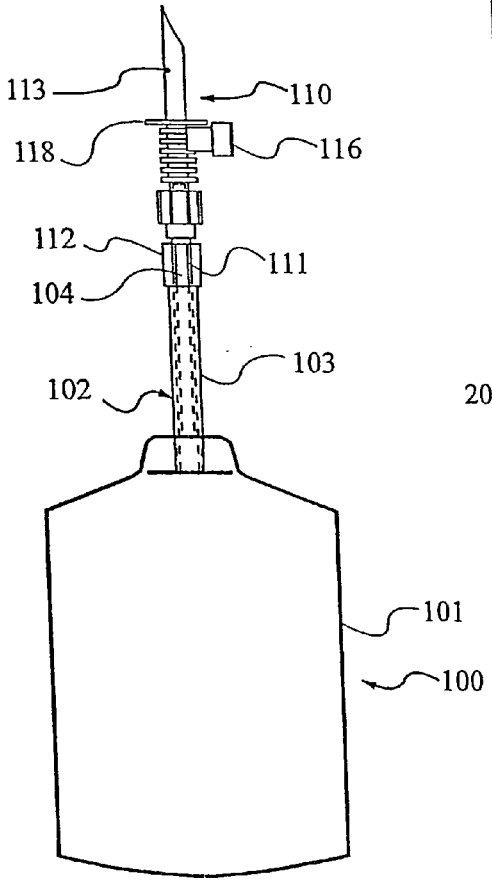
FIG. 1 is a front view of a standard flexible pouch utilized with a filling apparatus according to the invention.

FIG. 1 illustrates a flexible pouch 100 intended to be utilized with a filling device 1 of the present invention, that is the flexible pouch 100 is coupled to a filling cannula 110. The flexible pouch 100 typically includes a pouch 101 made of a flexible material and is designed to contain a medical liquid for injection. The pouch 101 is equipped with a reusable connection 102 comprising here a tube 103 at the end of which a nut 104 is mounted for free rotation. In this embodiment, the junction of the reusable connection 102 can therefore removably cooperate by a screw on fitting 111 at a proximal end 112 of the filling infuser 110.

Figure 2:
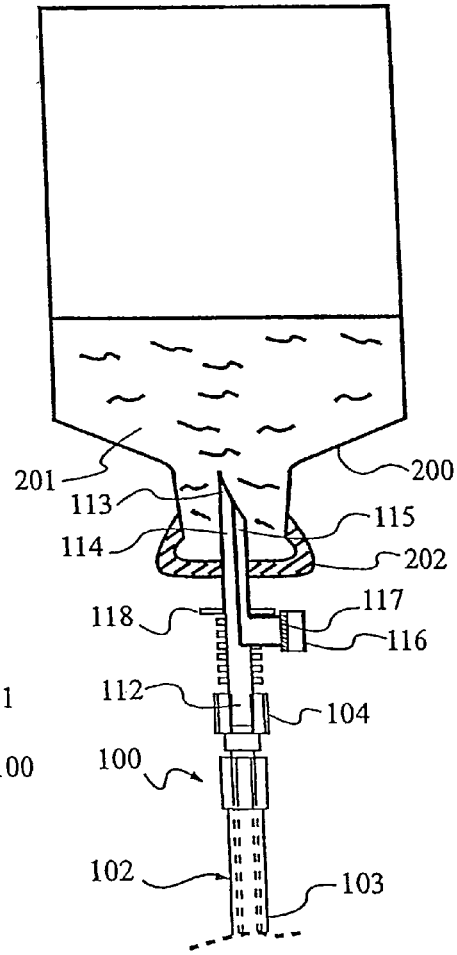
FIG. 2 is a sagittal sectional view representing a supply container coupled to the flexible pouch of FIG. 1.

In the model of FIG. 2, the filling infuser 110 includes in any case typically two conduits 114, 115. The first conduit 114 connects the distal end 113 that is intended to be connected to all exterior devices to a proximal end 112 that is intended to connect to the internal volume of the flexible pouch 100 via the reusable connection 102. The second conduit 114 connects the distal end 113 to a side air inlet 116 on the exterior and is equipped with a filter 117 impermeable to liquid but readily permeable to air. The filling infuser 110 additionally includes a pair of support stops 118 disposed laterally in opposition to each other and perpendicular to the longitudinal axis of the filling infuser 110.

FIG. 2 illustrates additionally the role of the needle 110 during a typical filling operation. Also, as can be seen, the filling infuser 110 is maintained vertically in orientation with its distal end 113 positioned towards the top; the pouch 101 (not shown) simply hangs down below. A supply container 200, containing a liquid 201 toward the bottom, is positioned in a manner that it can be coupled to the filling infuser 110 through the intermediary of its cap 202 through which the distal end 113 of the filling infuser 110 penetrates. In order to facilitate coupling and assure a watertight seal, the cap 202 is made of a material sufficiently soft to permit introduction of the distal part 113, advantageously fashioned in the form of a point.

The air inlet 116 can then fully fulfill its role and provide an entrance for air into the interior of the supply container 200, via the second conduit 115; the filter 117 blocks the flow of liquid 201 to the exterior. The flow of liquid 210 from the supply container 200 through the first conduit 114, it can also be realized, is permitted by the same in to fill the flexible pouch 100.

It is noted that the assembly of FIGS. 3 to 9 represents a preferred embodiment of the filling systems including two devices for currently filling conforming to the object of the present invention. The combination of plural filling devices does not change anything in the structure nor in the functional principle of each relative to one considered in isolation. In these figures, the description of only one of the filling devices is provided and is not repeated each time, for evident reasons of simplicity.

Figure 3:
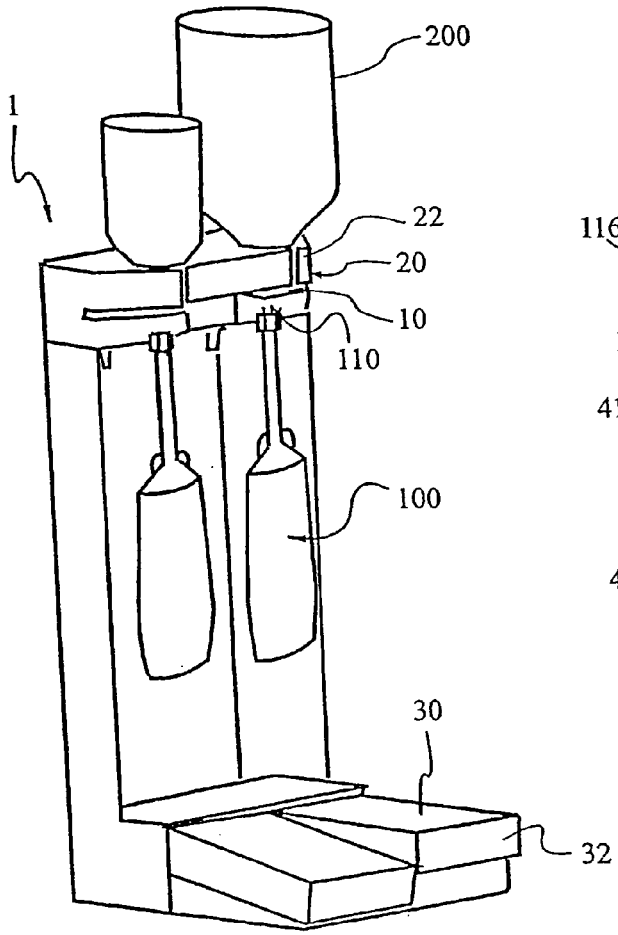
FIG. 3 is a perspective view of a filling device showing a first embodiment of the invention.

In this way now, FIG. 3 illustrates a filling device 1 according to the invention. A liquid 201 contained in the supply container 200 is intended for introduction into a flexible pouch 100 provided with the filling infuser 110 itself connected to an air inlet 116.

In this first embodiment, the filling device 1 is provided with an attaching means 10 permitting the positioning of the flexible pouch 100 in such a manner that the distal end 113 of the filling infuser 110 is disposed near the top.

The filling device 1 also includes a supporting means 20 permitting the positioning of the supply container 200 vertically of the flexible pouch 100 in a position that the liquid 201 can flow out by gravity when such supply container 200 is connected to the filling infuser 110.

The filling device 1 is additionally equipped with an air compressing means 30 which includes, in this embodiment, a flexible balloon or bladder 31 that is compressible by a pivotal pedal 32.

Finally, the filling device 1 includes a connecting means 40 which connects the air compressing means 30 with the filling infuser 110.

Figure 4:
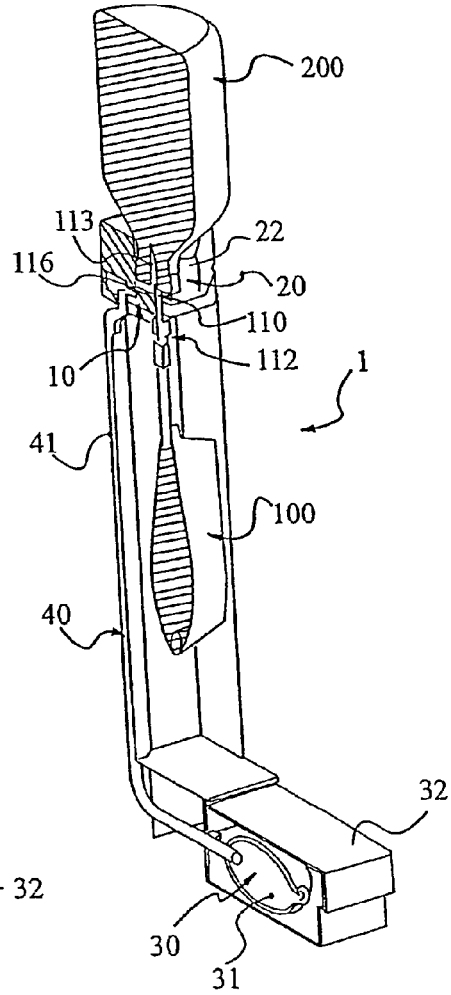
FIG. 4 shows a perspective view in partial transverse section of the filling device of FIG. 3.

Also, it can be seen especially in FIG. 4, the attaching means 10 are adapted to cooperate by connecting with at least one portion of the filling infuser 110. The support is also realized advantageously on a truly rigid part of the flexible pouch 100.

In the embodiment of FIGS. 3 to 8, the attaching means 10 includes an attachment hollow or bore 11 of complimentary form to the proximal part 112 of the filling infuser 110.

The attaching means 10 additionally includes a transverse vertical opening 12 extending between the attaching bore 11 and the exterior. This transverse vertical opening 12 is adapted to permit the filling infuser 110 to pass though in a vertical orientation particularly the proximal part 112 when it is positioned in the attachment bore 11 after insertion in the horizontal direction.

The attaching means 10 includes finally a transverse horizontal slot 13 between the attachment bore 11 and the exterior. The transverse horizontal slot 13 being adapted to permit the passage of the lateral supports 118 when the filling infuser 110 is placed in the attachment bore 11 after insertion in a horizontal direction.

The supporting means 20 includes a support bore 21 shaped complimentarily to the exterior of the supply container 200 and the cap 202.

In the present case, the support bore 21 is in the form of a cylinder whose diameter is complimentary to the neck of the supply bottles most commonly utilized.

The support means 20 are positioned in direct proximity to the attachment means 10 in that they are respectively intended for cooperating with the supply container 200 and with the filling infuser 110 after the latter are connected between them. Also the support means 20 includes a transverse vertical slot 22 extending between the support bore 21 and the exterior. This transverse vertical slot 22 is adapted to permit the passage of the distal part 113, oriented vertically, after insertion of the filling infuser 110 in the attachment bore 11 by insertion along a horizontal direction.

In a particularly advantageous manner, the transverse vertical slot 22 and the transverse vertical opening 12 are directly communicating with each other.

Also it can be seen in the embodiment of FIG. 4, the compressing means 30 include a flexible balloon or bladder 31 compressible by the intermediary of a pivoting pedal 32.

One can also see that the connecting means 40 includes a tube 41 connecting the flexible balloon 31 and a fitting 42 adapted for cooperatively connecting with the air inlet 116 of the filling infuser 110.

FIGS. 5 to 8 show the functioning of the filling device 1 according to the invention.

Figure 5:
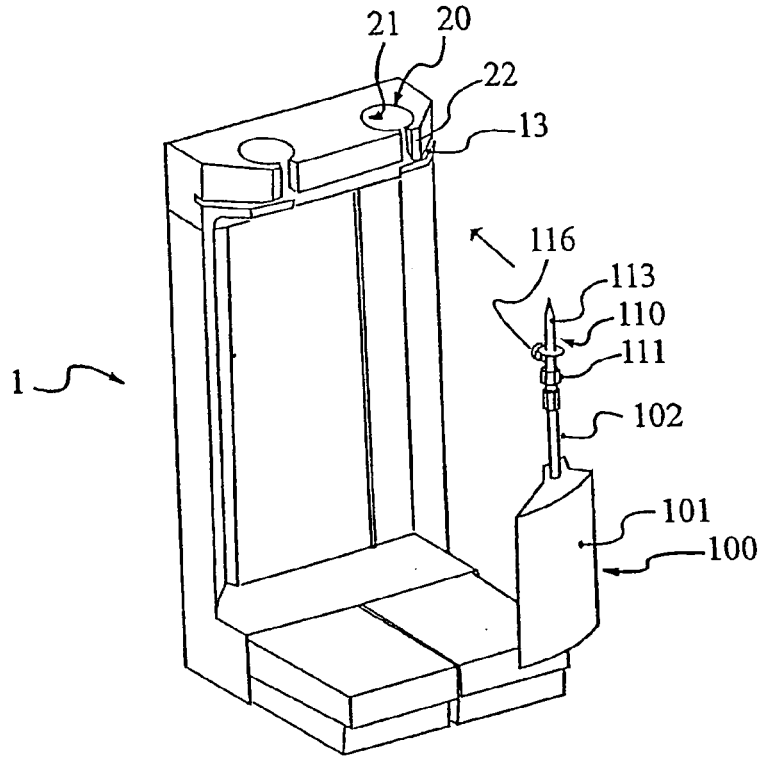
FIG. 5 represents in perspective a flexible pouch positioned in front of the filling device of FIGS. 3 and 4.

Referring to FIG. 5, the filling operation begins by putting in place the flexible pouch 100 coupled to its filling infuser 110. This latter, vertically oriented, proximal part 113 toward the top and air inlet 116 in the front, is introduced horizontally to traverse simultaneously the transverse vertical opening 12, the transverse horizontal slot 13, and the transverse vertical slot 22.

Figure 6:
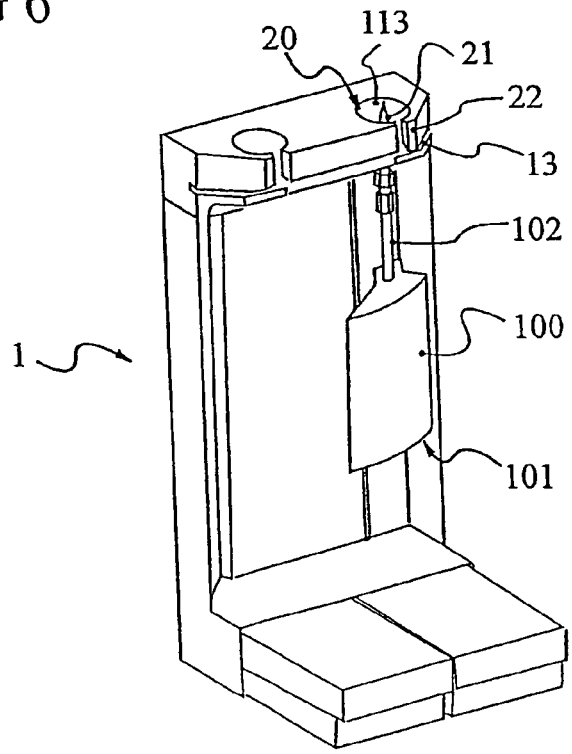
FIG. 6 shows in perspective the relative position of the flexible pouch and the filling device of FIG. 5 after being put in place.

The insertion ends as shown in FIG. 6, after firm pressure, the proximal part 12 is found inserted in the attachment bore 11 forming the attaching means 10. The end of the air inlet 116 is then inserted in the fitting 42 of complimentary form and the distal part 113 of the filling infuser 110 extends axially in the cylindrical attachment bore 21, forming the attaching means.

Figure 7:
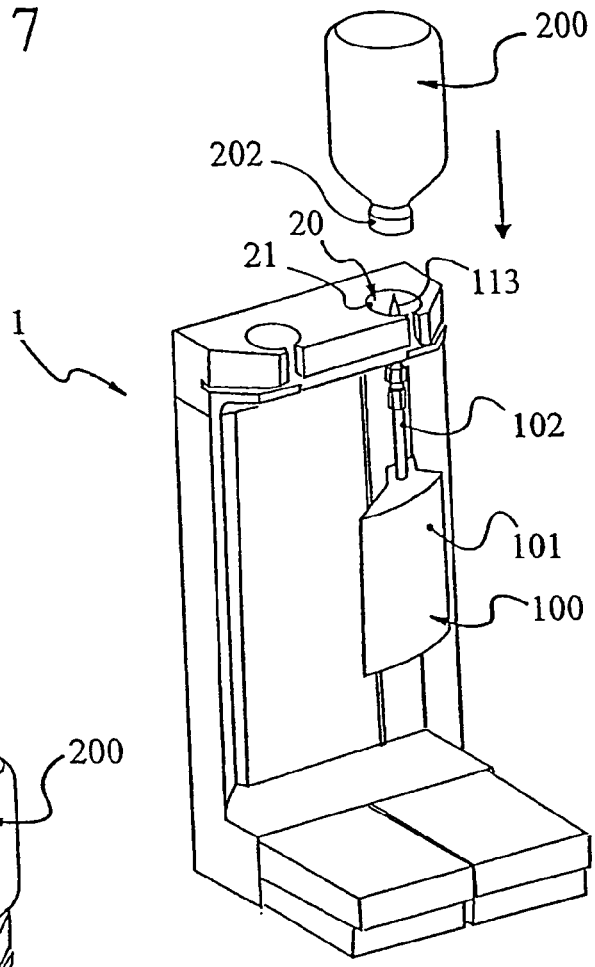
FIG. 7 is a perspective view illustrating the receipt of a supply container on the filling device equipped with the flexible pouch visible in FIG. 6.

Also it can be seen in FIG. 7, the supply container 200 is positioned vertically with the top cap 202 toward the bottom in the direction of the support means 20. The cap 202 is then driven on to the distal part 113 of the filling infuser 110 up through the entire neck of the supply container 200 in the attachment bore 21.

Figure 8:
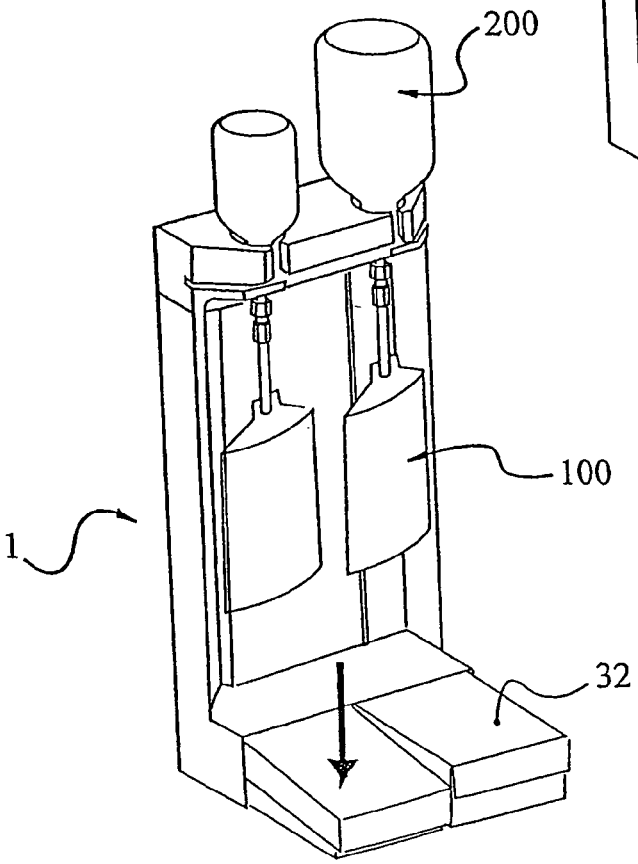
FIG. 8 is a perspective view showing the implementation of the filling device once the supply container is coupled to the flexible pouch of FIG. 7.

Referring to FIG. 8, no longer at rest, the compression means 30 gets to work by the manual action of the pivotal pedal 32. Partial squeezing of the compressible bulb 31 generates a positive pressure that is propagated up to the fitting 42 through the connecting means 40 then into the interior of the supply container 200 successively through the air inlet 116 and the conduit 115. The increase in pressure then forces liquid 201 to flow out through the conduit 114 and, consequently, to accelerate refilling of the flexible pouch 100.

Figure 9:
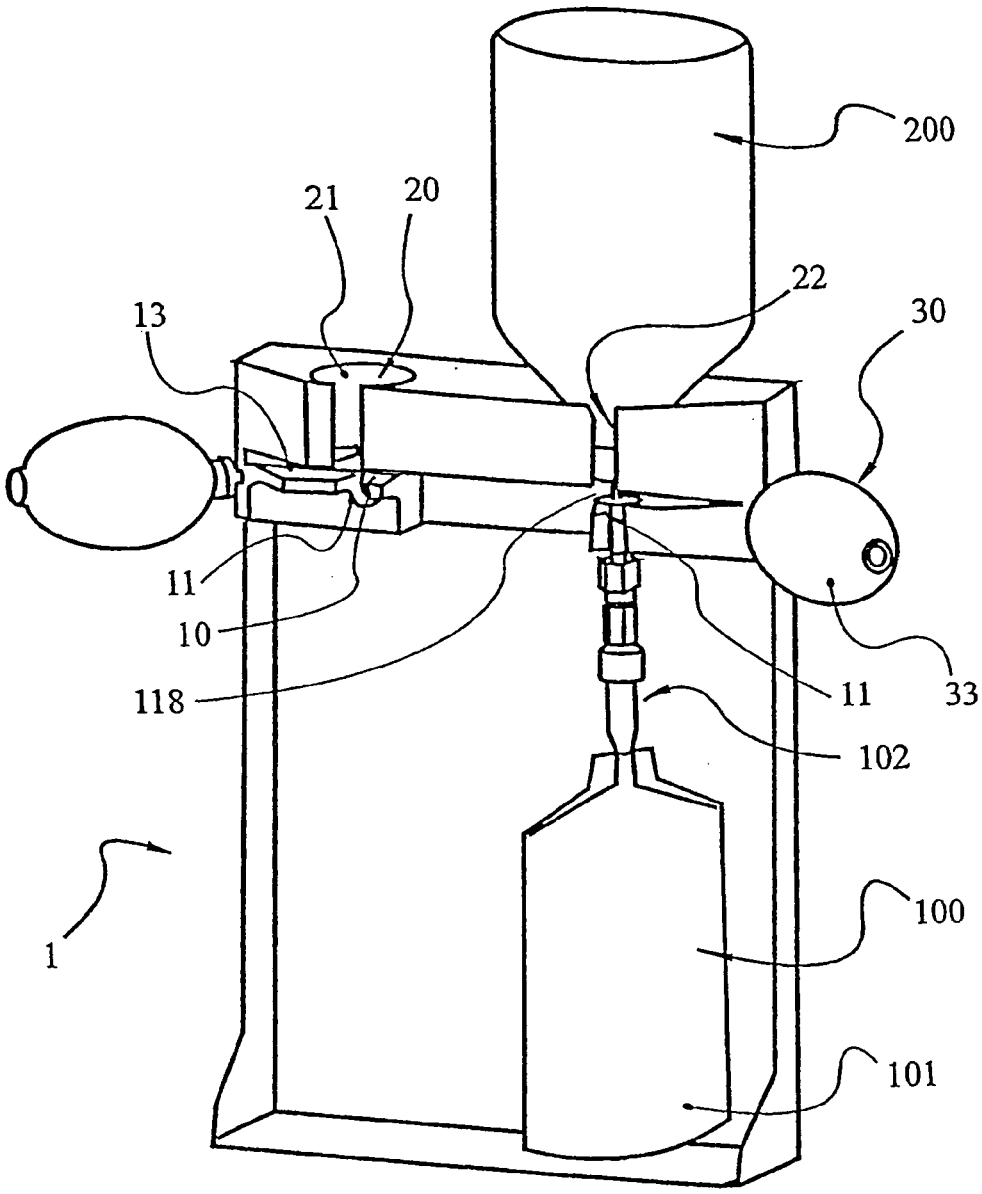
FIG. 9 represents in perspective a filling device showing a second embodiment of the invention.

In the second embodiment illustrated in FIG. 9, the compression means 30 presents itself simply in the form of a manually compressible squeeze bulb 33.

Naturally, the invention equally applies to refilling systems calling for at least two refilling devices 1 such as previously described. The configuration with two refilling devices 1 combined, such as shown in FIGS. 3 to 9, is particularly advantageous when it is necessary to refill two pouches simultaneously or one double pouch with two liquids. This is for example the case with double pouches of gadolinium and serum.

Of course the invention is not limited to the embodiments described and represented by way of example, but includes all equivalent techniques as well as combinations thereof.

The invention claimed is:

1. A filling apparatus, for introducing a liquid into a flexible pouch connected to a refilling infuser having an air inlet, the filling apparatus comprising:

a supporting means for a supply container containing the liquid for introduction, said supporting means being adapted for positioning said supply container in a position in which the liquid flows out by gravity when said supply container is connected with the filling infuser, an air compressing means, a connecting means that connects the compressing means and the air inlet of the filling infuser, and an attaching means for the flexible pouch adapted to position upwards a distal end of the filling infuser including an attachment bore having an approximately complimentary shape to a proximal pan of the infuser.

2. The filling apparatus according to claim 1, wherein the attaching means includes a transverse vertical opening extending between the attachment bore and the exterior, the transverse vertical opening being adapted to permit the passage of the filling infuser as it is put in place in the attaching bore by insertion along an approximately horizontal direction.

3. The filling apparatus according to claim 2 wherein the attaching means includes a transverse horizontal slot extending between the attachment bore and the exterior, said transverse horizontal slot being adapted to permit die passage of lateral support antis when the filling infuser is put in place in the attaching bore by insertion along a substantially horizontal direction.

4. The filling apparatus according to claim 1, wherein the supporting means includes a supporting bore of a shape approximately complimentary to die end of the supply container fitting a cap.

5. The refilling apparatus according to claim 4, wherein the supporting bore has a cylindrical shape.

6. A filling apparatus for introducing a liquid into a flexible pouch connected to a refilling infuser having an air inlet, the filling apparatus comprising:

an attaching means for the flexible pouch adapted to position upwards a distal end of the filling infuser, the attaching means including an attaching bore, a supporting means for a supply container containing the liquid for introduction, said supporting means being adapted for positioning said supply container in a position in which the liquid flows out be gravity when said supply container is connected with the filling infuser, the supporting means including a transverse vertical slot extending between the supporting bore and the exterior, said transverse vertical slot being adapted to permit the passage of the distal end of the filling infuser when the filling infuser is put in place in the attachment bore, by insertion along an approximately horizontal direction;

an air compressing means, a connecting means that connects the compressing means and the air inlet of the filling infuser.

7. The filling apparatus according to claim 6, wherein the transverse vertical slot and the transverse horizontal opening are in direct communication with each other.

8. The filling apparatus according to claim 1, wherein the compressing means includes a manually compressible squeeze bulb.

9. The filling apparatus according to claim 1, wherein the compressing means includes a flexible bladder compressible by a pivotal pedal.

10. The filling apparatus according to claim 1, wherein the connecting means includes a tube connecting the compressing means to a fitting adapted to cooperatively fit together with the air inlet of the filling infuser.

11. A filling system for flexible pouches, including: at least two filling apparatuses according to claim 1.

12. The filling apparatus according to claim 5, wherein the supporting means includes a transverse vertical slot extending between the supporting bore and the exterior, said transverse vertical slot being adapted to permit the passage of the distal end of the filling infuser when the filling infuser is put in place in the attachment bore, by insertion along an approximately horizontal direction.

* * * * *